United States Patent [19]

Seghezzi et al.

[11] 4,107,890

[45] Aug. 22, 1978

[54] FASTENING ASSEMBLY FOR REFRACTORY LININGS

[75] Inventors: Hans Dieter Seghezzi, Vaduz; Bernhard Klimesch, Mauren, both of Liechtenstein; Reinhold Zsalatz, Rankweil, Austria

[73] Assignee: Hilti Aktiengesellschaft, Schaan, Liechtenstein

[21] Appl. No.: 752,097

[22] Filed: Dec. 20, 1976

[30] Foreign Application Priority Data

Dec. 22, 1975 [DE] Fed. Rep. of Germany ..... 2557846

[51] Int. Cl.[2] ..... E04B 1/16

[52] U.S. Cl. ..... 52/379; 52/513; 52/713; 110/336

[58] Field of Search ..... 52/713, 714, 715, 379, 52/587, 701, 704, 706, 707, 708, 513; 110/1 A

[56] References Cited

U.S. PATENT DOCUMENTS

| | | | |
|---|---|---|---|
| 1,088,290 | 2/1914 | McAllister | 52/707 |
| 1,750,841 | 3/1930 | Hopper | 52/379 |
| 1,929,835 | 10/1963 | Awbrey | 52/379 |
| 2,923,146 | 2/1960 | Mayer | 52/704 |
| 3,274,744 | 9/1966 | Blum | 52/704 |
| 3,479,785 | 11/1969 | Asch | 52/701 |
| 3,687,093 | 8/1972 | Byrd | 110/1 A |

FOREIGN PATENT DOCUMENTS

| | | | |
|---|---|---|---|
| 1,258,300 | 3/1961 | France | 52/704 |
| 41,955 | 1/1917 | Sweden | 52/708 |

*Primary Examiner*—Ernest R. Purser
*Assistant Examiner*—Henry Raduazo
*Attorney, Agent, or Firm*—Toren, McGeady and Stanger

[57] ABSTRACT

In a foundation wall for a furnace, a fastening element is provided for securing a refractory lining on the foundation wall. The fastening assembly consists of a first part and a second part. The first part is wholly disposed within the foundation wall and a second part is secured to the first part and projects outwardly from the foundation wall. The second part is detachably mounted on the first part and includes a base plate and an anchoring element which can be affixed to or releasably secured to the base plate.

5 Claims, 2 Drawing Figures

FASTENING ASSEMBLY FOR REFRACTORY LININGS

SUMMARY OF THE INVENTION

The present invention is directed to a fastening assembly for attaching a refractory lining to the foundation wall of a furnace or the like.

Known systems for securing refractory linings in industrial furnaces or on parts of machines or apparatus which are exposed to heat, consist of single or multipart elements which are secured either on the supporting part, that is, the furnace casing or on the foundation wall (insulating wall) itself. These elements project outwardly from the foundation wall and the refractory lining is molded onto them, for example, by means of a so-called injection-molding lining mass.

Because of the great thermal stress experienced, the refractory lining must be replaced more frequently than the foundation wall. Such removal of the lining is effected usually by means of mechanical tools. However, the anchoring or fastening elements are frequently separated from the foundation wall or are deformed to such an extent that they can no longer be used.

The insertion of new fastening elements is very time consuming, and, therefore, costly. If the elements are broken out during the removal of the lining, the foundation wall is frequently damaged and must be repaired.

Therefore, the present invention is directed to the problem of providing a fastening device which insures the attachment of the refractory lining to the foundation wall, and also simplifies the replacement of the lining.

In accordance with the present invention, the problem is solved by utilizing a fastener assembly having a first or receiving part secured in the foundation wall so that it does not extend outwardly from the surface of the wall and a refractory attaching part detachably connected to the receiving part and extending outwardly from the foundation wall. Due to the separability of the two parts at the interface between the foundation wall and the lining, the receiving part remains in the foundation wall and is not damaged when the refractory lining is removed. The attaching part is removed together with the lining and can be reused. Since the assembly is required only to transmit shearing forces at the interface, the holding force in the axial direction can be low. This characteristic facilitates the separation of the parts during the removal of the lining.

For distributing the load to the foundation wall, it is advantageous if the receiving part is pot-shaped or box-shaped. The shearing forces can be transmitted to the foundation wall without excessive stresses appearing at some points. The tensile forces at the interface between the attaching part and receiving part, which are produced by tilting movement, are smaller the further the connections between the two parts are from the lower bearing edge of the attaching part. Accordingly, it is advantageous if the box-shaped receiving part is made as large as possible. There are limits, however, to the size of the box-shaped part due to the spacing of the individual fastening assemblies from one another and also for economic reasons.

To protect the lining material from penetrating into the receiving part, and to produce a form-locking connection of the attaching part with the lining, it is advisable if the attaching part has a base plate which contacts the receiving part and an anchoring element projecting from the face of the base plate directed outwardly from the receiving part, that is, away from the foundation wall. In addition to its covering effect, the base plate, by bearing on the receiving part and the foundation wall, it also serves as an axial stop. To keep the tensile forces as small as possible at the connection between the parts, the base plate should be as large a possible. The anchoring element can be formed integrally with the base plate or it can be joined to it, such as by welding.

In one advantageous embodiment of the invention, the base plate of the attaching part is provided with projections for connecting it to the receiving part. Such projections can also be used for centering.

To provide a reliable but detachable connection of the attaching part to the receiving part, it is advisable if the projections are designed as fingers formed from the base plate, such fingers can be resilient so that they snap into a locking groove in the receiving part. With this type of connection the required shearing forces can be transmitted and the attaching part can be easily disengaged from the receiving part during the removal of the lining.

For a simple arrangement for the base plate, it is advantageous if the projections are provided by pins traversing the base plate. Such pins can be formed of a softer material than the base plate and can have a slightly larger diameter than the corresponding bores in the receiving part into which they are inserted, so that a clamping first is effected as the pins are driven into the bores. When the attaching part is reused, the pins can be simply replaced. To improve the attachment, the pins can also be provided with clamping tongues.

Where the attaching part is to be used where special conditions exist, such as a different thickness or position of the lining, it is advantageous if the anchoring element is detachably connected to the base plate. The detachable connection can be provided by means of a threaded interengagement or by a bayonet lock. It is thus possible to use anchoring elements of different form and length in the same base plate. The base plates themselves can thus be produced in correspondingly greater quantity.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
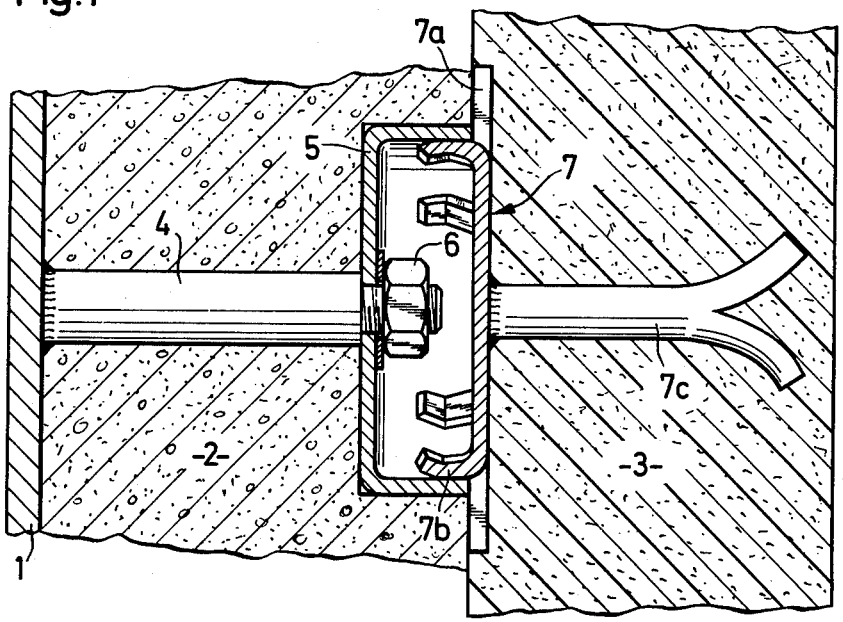
FIG. 1 is a sectional view through a portion of a furnace wall illustrating a fastening assembly embodying the present invention.

As can be seen in FIG. 1, the furnace wall consists basically of three layers, a furnace casing 1, a foundation wall 2 abutting the furnace casing, and a lining 3 deposited on the foundation wall. The foundation wall can, in turn, consist of several layers, for example, layers of insulating wool and fireclay brick. In FIG. 1 a fastening assembly is shown for securing the refractory lining 3 onto the foundation wall 2. The fastening assembly includes a bolt 4 secured to the furnace casing 1 and extending inwardly through the foundation wall 2 toward the inner surface of the foundation wall. On the opposite or inner surface of the foundation wall 2 from the furnace casing 1, a pot-shaped or box-shaped receiving part 5 is counter-sunk so that the open face of the part is in a plane flush with the inner surface of the foundation wall. The receiving part 5 is secured onto the bolt 4 by means of a nut 6. The combination of the bolt 4, the receiving part 5, and the nut 6 are all located wholly within the foundation wall.

Secured to the receiving part 5 is an attaching part 7 which includes a base plate *7a* forming a cover for the open side of the box-shaped part 5. The attaching part 7 includes resilient fingers *7b* which project from the base plate *7a* into the open side of the receiving part 5 and serve to connect the attaching part 7 to the receiving part 5. Welded on the surface of the base plate *7a* facing away from the foundation wall is an anchor element *7c* which projects from the plate outwardly into the refractory lining 3. The opposite end of the anchoring element *7c* and the end attached to the base plate is split longitudinally and spread outwardly to improve the form-locking engagement with the lining 3. When the lining 3 is removed, the attaching part 7 is separated from the receiving part which remains in the foundation wall 2. Before a new lining 3 is applied, undamaged or new attaching parts 7 are simply inserted into the openings of the receiving part 5.

Figure 2:
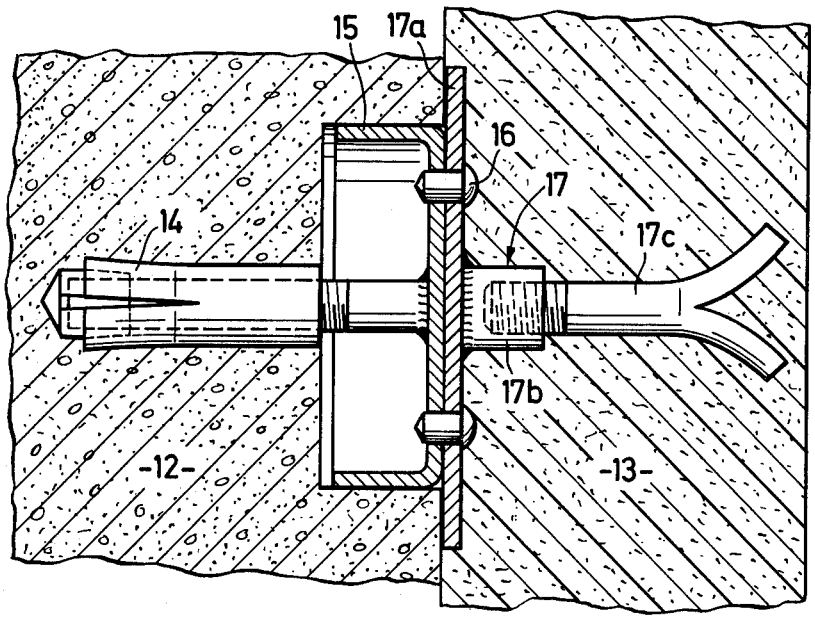
FIG. 2 is a view similar to FIG. 1 showing another embodiment of the fastening assembly in accordance with the present invention.

Another embodiment of the invention is shown in FIG. 2 with a receiving part 15 being secured by a known expansion dowel 14 in the foundation wall 12. While the receiving part 15 is still pot-shaped or box-shaped, its position is reversed with regard to that shown in FIG. 1 so that its open side is located inwardly of the surface of the foundation wall 12 to which the lining is applied. Due to the threaded interconnection between the expansion dowel 14 and the receiving part 15, there is the possibility of adjusting the axial position of the receiving part. Accordingly, the receiving part 15 can have its surface facing the lining exactly flush with the inner surface of the foundation wall 12 or it can be recessed inwardly into the foundation wall by a certain amount. The attaching part 17 which is incorporated into the lining 13 includes a base plate 17*a* which covers the receiving part, a threaded bush 17*b* is welded to the surface of the base plate facing away from the foundation wall, and an anchoring element 17*c* is threaded into the bush. The attaching part 17 is connected to the receiving part 15 by a plurality of rivet-type pins 16. These pins can be formed of a softer material than the receiving part and they can have a slightly larger diameter than the diameter of the bores in the receiving part into which they are inserted. Such pins effect a clamping fit with the receiving part when the attaching part 17 is mounted on the receiving part 15. Since the base plate 17*a* and the anchoring element 17*c* are separate members, it is possible to manufacture the base plate 17*a* in large quantities and to insert the anchoring elements into the base plates in accordance with the desired thickness of the lining to be applied to the foundation wall. During the removal of the lining, if only one of the elements of the attaching part is damaged, the other element can be reused. The pins absorb the shearing forces and only minor holding forces are required in the direction of removal of the attaching part from the receiving part. Additional insulation can be placed between the receiving part 15 and the base plate 17*a*.

While specific embodiments of the invention have been shown and described in detail to illustrate the application of the inventive principles, it will be understood that the invention may be embodied otherwise without departing from such principles.

What is claimed is:

1. A fastening assembly for use in securing a refractory lining onto a foundation wall in a furnace or the like, wherein the improvement comprises that said fastening assembly includes a receiving part to be anchored in the foundation wall so that the receiving part is wholly included within the foundation wall, an attaching part detachably connected to said receiving part and extending outwardly from said receiving part, said receiving part including a box-shaped member for securement within the foundation wall, said attaching part comprising a base plate and an anchoring element secured to and extending outwardly from said base plate away from said receiving part, projections being disposed in said base plate and extending therefrom into said box-shaped member for securing said attaching part to said receiving part, and said projections comprising fingers formed from said base plate and extending outwardly therefrom.

2. A fastening assembly for use in securing a refractory lining onto a foundation wall in a furnace or the like including a receiving part to be anchored in the foundation wall so that the receiving part is wholly included within the foundation wall, an attaching part detachably connected to said receiving part and extending outwardly from said receiving part, said receiving part comprises a box-shaped member for securement within the foundation wall, wherein the improvement comprises said box-shaped member having a first face surface arranged to be directed into the foundation wall and spaced inwardly from the surface of the foundation wall and an oppositely directed second face surface spaced from said first face surface, said attaching part comprises a base plate and an anchoring element secured to and extending outwardly from said base plate, said base plate having a first surface arranged to face toward said box-shaped member and an oppositely directed second face, said first face surface and said base plate disposed in contact with the second face surface of said box-shaped member, said base plate being detachably connected to said box-shaped member, and said anchoring element having a first end and a second end with the first end thereof secured to said second face surface of said base plate, said anchoring element extending transversely of the surface and said second face surface of said base plate, the second end of said anchoring element located outwardly from said base plate on the opposite side thereof from said box-shaped member and projections disposed in said base plate and extending therefrom into said box-shaped member for securing said attaching part to said receiving part.

3. A fastening assembly as set forth in claim 2, wherein said projections members comprise pins extending through said base plate and projecting therefrom into engagement within the box-shaped member.

4. A fastening assembly for use in securing a refractory lining onto a foundation wall in a furnace or the like including a receiving part to be anchored in the foundation wall so that the receiving part is wholly included within the foundation wall, an attaching part detachably connected to said receiving part and extending outwardly from said receiving part, said receiving part comprises a box-shaped member for securement within the foundation wall, wherein the improvement comprises said box-shaped member having a first face surface arranged to be directed into the foundation wall and spaced inwardly from the surface of the foundation wall and an oppositely directed second face surface spaced from said first face surface, said attaching part comprises a base plate and an anchoring element secured to and extending outwardly from said base plate, said base plate having a first surface arranged to face toward said box-shaped member and an oppositely directed second face, said first face surface of said base plate disposed in contact with the second face surface of said box-shaped member, said base plate being detachably connected to said box-shaped member, and said anchoring element having a first end and a second end with the first end thereof secured to said second face surface of said base plate, said anchoring element extending transversely of the surface of said second face surface of said base plate, the second end of said anchoring element located outwardly from said base plate on the opposite side thereof from said box-shaped member, and said based plate extending across and projecting laterally outwardly beyond the lateral surfaces of the second face surface of said box-shaped member of said receiving part.

5. A fastening assembly for use in securing a refractory lining onto a foundation wall in a furnace or the like including a receiving part to be anchored in the foundation wall so that the receiving part is wholly included within the foundation wall, an attaching part detachably connected to said receiving part and extending outwardly from said receiving part, said receiving part comprises a box-shaped member for securement within the foundation wall, wherein the improvement comprises said box-shaped member having a first face surface arranged to be directed into the foundation wall and spaced inwardly from the surface of the foundation wall and an oppositely directed second face surface spaced from said first face surface, said attaching part comprises a base plate and an anchoring element secured to and extending outwardly from said base plate, said base plate having a first surface arranged to face toward said box-shaped member and an oppositely directed second face, said first face surface of said base plate disposed in contact with the second face surface of said box-shaped member, said base plate being detachably connected to said box-shaped member, and said anchoring element having a first end and a second end with the first end thereof secured to said second face surface of said base plate, said anchoring element extending transversely of the surface of said second face surface of said base plate, the second end of said anchoring element located outwardly from said base plate on the opposite side thereof from said box-shaped member, and the end of said anchoring element spaced from said base plate is bifurcated with the bifurcated ends spread apart for effecting increased attachment capabilities.

* * * * *